US006484691B1

(12) United States Patent
Schuster et al.

(10) Patent No.: US 6,484,691 B1
(45) Date of Patent: Nov. 26, 2002

(54) SYSTEM AND METHOD FOR DETECTING AND INFLUENCING THE PHASE POSITION OF AN INTERNAL COMBUSTION ENGINE

(75) Inventors: Thomas Schuster, Allmersbach; Ingolf Rupp, Ludwigsburg; Andreas Roth, Muehlacker-Lomersheim, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/763,744

(22) PCT Filed: Jul. 13, 2000

(86) PCT No.: PCT/DE00/02291

§ 371 (c)(1),
(2), (4) Date: Feb. 26, 2001

(87) PCT Pub. No.: WO01/07770

PCT Pub. Date: Feb. 1, 2001

(30) Foreign Application Priority Data

Jul. 21, 1999 (DE) ..... 199 34 112

(51) Int. Cl.[7] ..... F02P 17/04

(52) U.S. Cl. ..... 123/305; 123/643; 701/105; 73/116; 73/117.3

(58) Field of Search ..... 73/116, 117.3; 123/305, 295, 643; 701/105

(56) References Cited

U.S. PATENT DOCUMENTS

| | | | | | |
|---|---|---|---|---|---|
| 3,972,230 | A | * | 8/1976 | Hanson et al. | 73/116 |
| 4,870,587 | A | * | 9/1989 | Kumagai | 123/643 |
| 5,284,114 | A | | 2/1994 | Fukui | |
| 5,402,675 | A | * | 4/1995 | Entenmann et al. | 73/117.3 |
| 5,417,194 | A | | 5/1995 | Augustin | |
| 5,447,143 | A | | 9/1995 | Ott | |
| 5,613,473 | A | * | 3/1997 | Angermaier | 123/399 |
| 5,823,166 | A | * | 10/1998 | Entenmann et al. | 73/117.3 |
| 5,881,694 | A | * | 3/1999 | Nakada | 123/305 |
| 5,970,784 | A | * | 10/1999 | Genin | 73/117.3 |

FOREIGN PATENT DOCUMENTS

| | | |
|---|---|---|
| DE | 42 30 616.7 | 9/1992 |
| DE | 44 18 578 | 5/1994 |
| DE | 197 41 820 A | 5/1999 |
| FR | 2 720 445 A | 12/1995 |
| GB | 2 044 463 A | 10/1980 |

* cited by examiner

*Primary Examiner*—Erick Solis
(74) *Attorney, Agent, or Firm*—Michael J. Stricker

(57) ABSTRACT

The invention relates to an apparatus and a method for controlling and regulating an internal combustion engine 6; via a transducer disk 16 on the crankshaft 12 and a pickup 15, the annular position of the crankshaft 12 is ascertained continuously, with gasoline direct injection valves, in which the fuel injection valves 5 receive the fuel 1 from a pressure-imposing electric fuel pump 9 via a fuel rail 7. A control unit 25 evaluates the output signals of the pickup 15 to determine the annular position and to ascertain the rpm; depending on the annular position, the control unit 25 trips injection and/or ignition pulses. According to the invention, to detect the phase relationship of the engine 6, the pressure course in the fuel rail sensor 8 is evaluated. Upon blowback at compression counterpressure of fuel-air mixture into one of the injection valves in the event of an incorrect phase relationship offset by 360° KW, this leads to a significant pressure increase in the fuel rail sensor 8; the fuel rail sensor signal is delivered to the control unit 25, and as a result by means of the control unit a reverse synchronization by 360° KW of the ignition and injection is effected, and the affected fuel injection valve 5 into which the blowback takes place is immediately closed.

7 Claims, 3 Drawing Sheets

Figure 1:
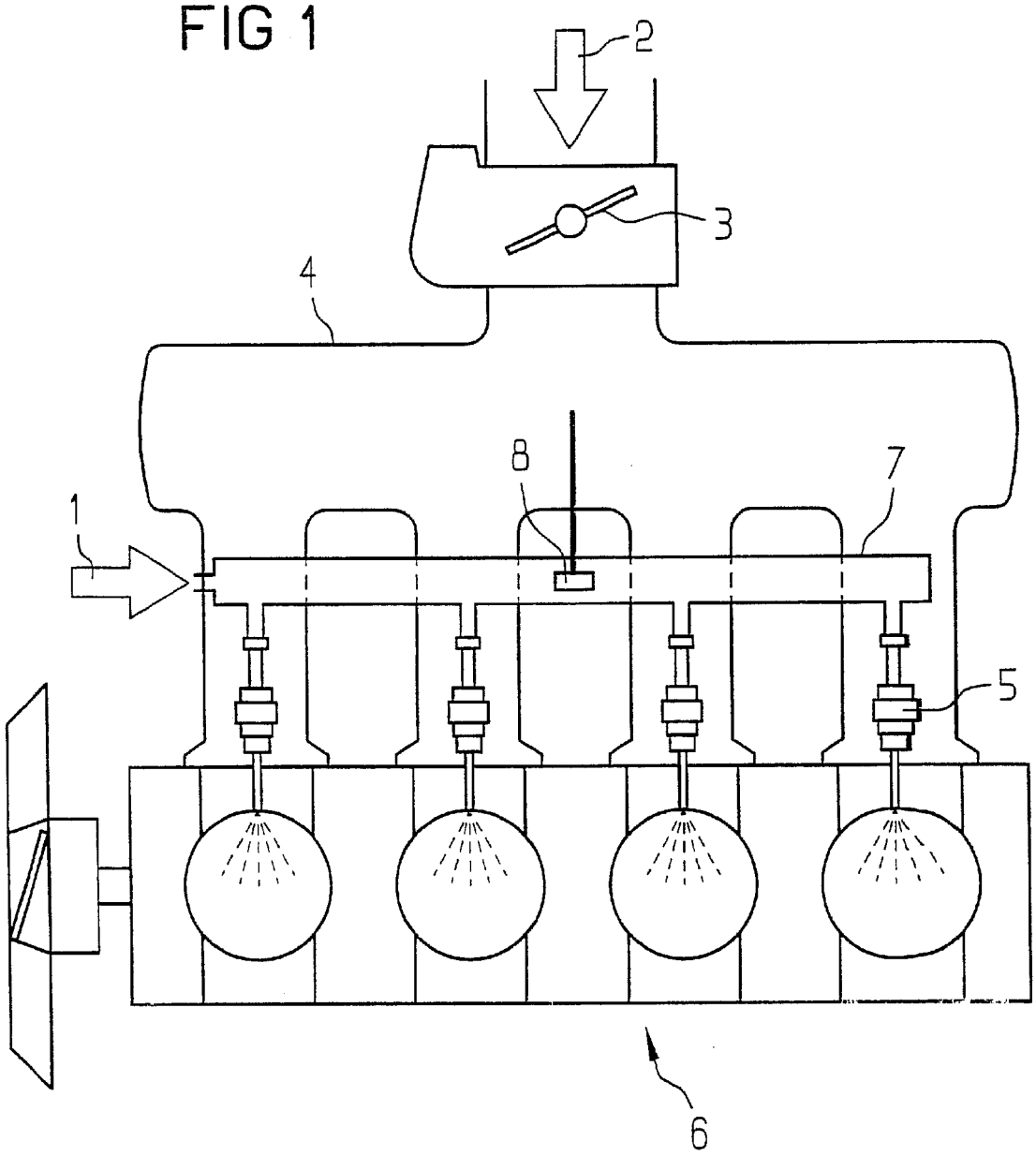

SYSTEM AND METHOD FOR DETECTING AND INFLUENCING THE PHASE POSITION OF AN INTERNAL COMBUSTION ENGINE

The invention relates to an apparatus and a method for detecting and varying the phase relationship in an internal combustion engine, as generically defined by the preamble to the main claim.

In an internal combustion engine, especially one with a plurality of cylinders, with a crankshaft and a camshaft, the engine control unit, as a function of the position detected for the crankshaft or camshaft, calculates when fuel is to be injected, into which cylinder, and at which instant the ignition must be tripped. It is usual to ascertain the annular position of the crankshaft with the aid of a pickup, which scans the crankshaft, or a transducer disk with a characteristic surface that is connected to the crankshaft. On the basis of the pulse train obtained, the control unit can detect the angular association.

Since the crankshaft rotates twice within one operating cycle, in the case of a four-stroke engine, however, it is not possible to determine the phase relationship of the engine unambiguously solely by scanning the crankshaft. If the phase relationship is wrong, the ignition and injection are output by the control unit with a transposition of 360° KW. Because of the fact that one cycle of a four-stroke engine amounts to 720° KW, and solely by means of the sensor in the transducer wheel it cannot be determined which of the four strokes is present.

If the phase signal is defective, in statistical terms every other attempt at starting will fail, since the ignition and injection are output incorrectly by the control unit by the amount of 360° KW crankshaft. The motor accordingly fails to turn over. Furthermore, in a direct gasoline injection engine, gas from the combustion chamber is forced back into the injection valves and the fuel rail, which then impairs the starting performance even if the phase relationship is correct.

For the phase relationship to be detected correctly, the prior art typically provides a second pickup or sensor, which scans a transducer disk, communicating with the camshaft, that has a reference marking on its surface. Since the camshaft rotates only once during one work cycle, from the signal furnished by the camshaft sensor, with a single pulse per work cycle, the control unit can detect the phase relationship of the engine and perform a synchronization. Such a system is described for instance in German Patent Application P 4230616.7.

German Patent Disclosure DE-OS 4418578 discloses an apparatus for detecting the phase relationship in an internal combustion engine that makes do without a second sensor in the form of a camshaft sensor, by performing a check of the phase relationship under certain conditions; this condition is advantageously the resumption of sequential fuel injection after the overrunning shutoff. More precisely, by way of a segment time comparison, it is ascertained here whether the rpm of individual injected cylinders occurs in the expected annular position, and from this the conclusion of a correct or incorrect phase relationship is drawn; the term "segment time" means a time that elapses while the crankshaft rotates by an angle that is generally designated as a segment.

In direct gasoline injection engines with one fuel injection valve per piston of an internal combustion engine, the emergency operation concept of intake tube injection with dual ignition cannot be employed. Furthermore, if the phase relationship is wrong, gas is forced out of the combustion chamber back into the injection valves and the fuel rail, which means that even if the phase relationship is correct, the starting performance is impaired, or starting is prevented entirely.

The present invention therefore has the object of disclosing an apparatus and a method by which detection of the phase relationship is possible at starting, and by which an improved starting performance in the event of failure of the phase signal is obtained. According to the invention, this object is attained by the body of the main claim and by the dependent claims.

The apparatus according to the invention has the a substantial advantage that already existing component groups and components can be used; no additional camshaft sensor is required, and no extra pressure sensors are necessary, either. The rail pressure evaluation is typically done directly in the control unit, without additional circuitry. Optionally, the pressure signal of the fuel rail signal can also be delivered to the control unit for evaluation by way of a simple analog/digital comparator circuit.

After detection of the reference marking, a special injection without ignition takes place in one of the fuel injection valves at top dead center.

If the phase relationship is wrong at the time of engine starting, the affected injection valve into which blowback occurs from the compression counterpressure is immediately closed, and the pressure increase is imparted to the control unit, for instance via the analog/digital comparator circuit. A reverse synchronization of the injection and ignition by 360° KW is thereupon tripped by the control unit.

One exemplary embodiment of the invention is shown in the drawings.

Figure 2:
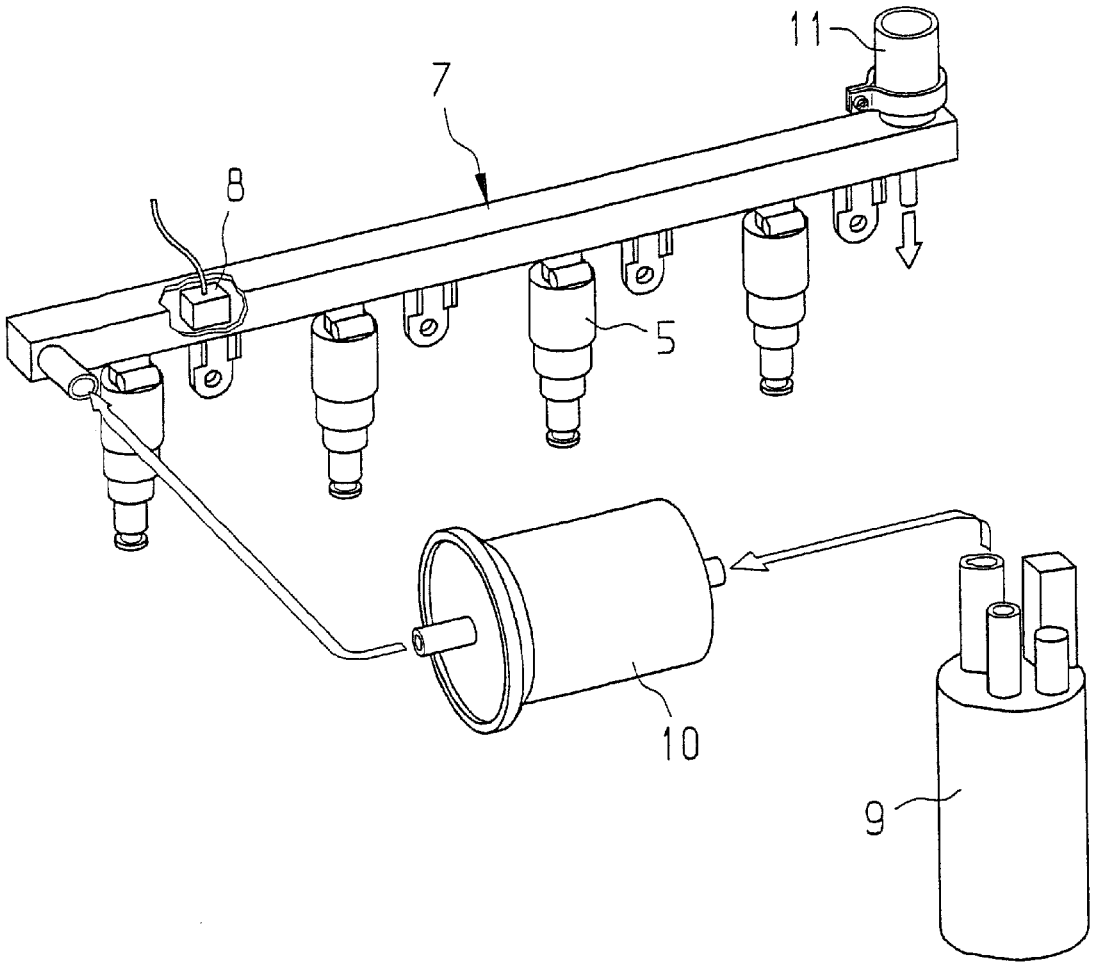
Figure 3:
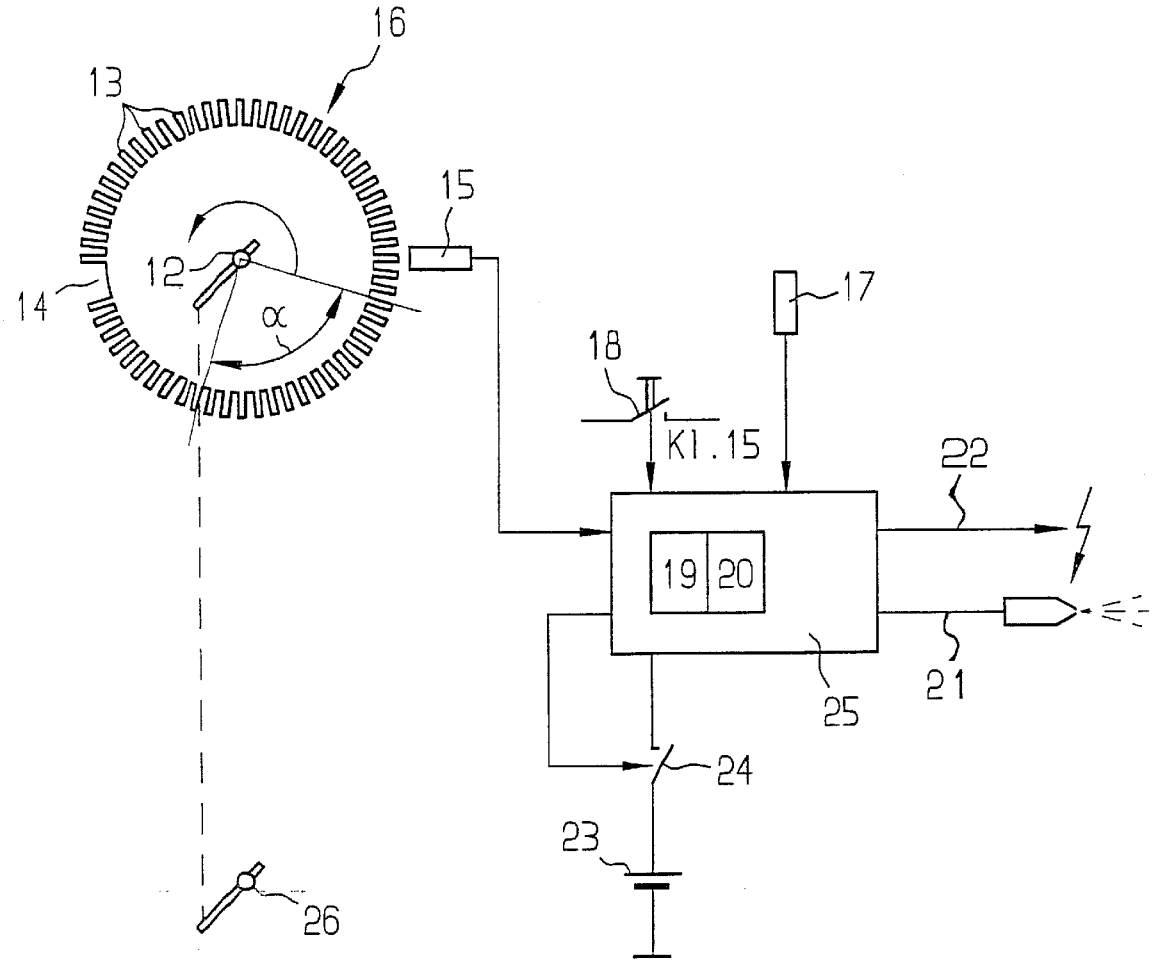

Shown are:

FIG. 1: a schematic illustration of a four-cylinder engine;

FIG. 2: a fuel rail for a four-cylinder engine;

FIG. 3: a basic diagram of an engine control apparatus.

FIG. 1 indicates the aspirated fuel, identified by reference numeral 1, which by means of the electric fuel pump, identified in FIG. 2 by reference numeral 9, is pumped into the fuel rail 7. The fuel rail is a constituent part of gasoline direct injection engines, and on each cylinder of the internal combustion engine 6, it has branches for the injection valves 5, which under electromagnetic control inject the fuel directly into the combustion chamber. Reference numeral 2 indicates the aspirated air, 3 is the throttle valve, and 4 is the intake tube, which also has branches to each cylinder. Reference numeral 8 indicates the fuel rail sensor, functioning as a pressure sensor, which measures the prevailing pressure in the fuel rail. In the direct injection shown in FIG. 1, the engine during normal operation aspirates only air, and no longer aspirates the fuel-air mixture. The mixture formation in the combustion chamber makes two completely different modes of operation possible. In one case, in stratified operation, the mixture needs to be ignitable only in the region of the spark plug. The other, remaining portion of the combustion chamber then contains only fresh and residual gas, without any uncombusted fuel. In the idling and partial-load range, the result is then a very lean mixture, with an attendant reduction in fuel consumption.

In the other case, involving homogeneous operation, a homogeneous mixture exists within the entire combustion chamber, as in the case of external mixture formation. All the fresh air available in the combustion chamber takes part in the combustion process. This operating mode is employed in the range of full load.

FIG. 2 shows a perspective view of the fuel rail 7 for a four-cylinder with four injection valves 5, the pressure regulator 11, and the fuel rail sensor 8 functioning as a pressure sensor. Reference numeral 10 indicates the fuel filter, while 9 indicates the electric fuel pump.

The control or regulation of the engine 6 with direct gasoline injection is performed by the control unit 25 shown in FIG. 3.

Reference numeral 16 indicates the transducer disk, which is rigidly connected to the crankshaft 12 of the engine 6 and which on its circumference has many identical angle markings 13. Besides these identical angle markings 13, there is a reference marking 14, which is embodied for instance by two missing angle markings. The transducer disk 16 is scanned by the pickup 15, which for instance is an inductive pickup or a Hall sensor or a magnetoresistive sensor. The signals generated in the pickup 15 as it moves past the angle markings 13 are processed in a suitable way in the control unit 25.

A phase sensor, which scans the camshaft 26 or a disk connected to the camshaft 26 and having a marking, which is present in conventional internal combustion engines, is not needed here. The information pertaining to the phase relationship, which is typically obtained from the output signal of such a sensor, is obtained here with the aid of the method steps in claims 5–6 and by means of the pressure sensor signal in the form of the fuel rail sensor 8.

By way of various inputs, the control unit 25 receives further input variables that are required for controlling or regulating the engine and that are measured by various sensors. In FIG. 3, these sensors are identified by reference numeral 17. Via one further input, an "ignition on" signal is delivered, which upon closure of the ignition switch 18 is furnished by the terminal 15 of the ignition key and indicates to the control unit 25 that the engine has been put into operation.

The control unit 25 itself includes at least one central processor unit 20 along with memory 19. In the control unit 25, signals for the injection and ignition are ascertained for engine components not identified by reference numeral. These signals are output via the outputs 21 and 22 of the control unit 25.

The supply of voltage to the control unit 25 is done in the usual way with the aid of the battery 23, which during engine operation as well as a coasting phase after the engine has been shut off is connected to the control unit 25 via the switch 24. In the coasting phase, the information that continues to be ascertained after the shutoff of the engine 6 is stored in memory; this information is then immediately available to the control unit 25 when the engine 6 is turned back on again. This information includes in particular the most recent annular positions of the crankshaft and camshaft 12 and 26, respectively, along with information pertaining to the most recent phase relationship.

In a system that seeks to make do without a phase sensor, that is, without a sensor that ascertains the position of the camshaft, there is the problem that the reference marking signal furnished by the crankshaft sensor is ambiguous, since in a four-stroke engine the crankshaft 12 rotates twice during one work cycle, while the camshaft 26 rotates only once. To detect the phase relationship, the control unit 25 therefore varies the phase relationship, under certain operating conditions and especially upon starting, in such a way that if the phase relationship is incorrect, which can be measured via the fuel rail sensor 8, the phase relationship of the ignition and injection is reverse-synchronized by 360° KW via the control unit 25. To that end, the pressure sensor is disposed in the fuel rail and is identical with the fuel rail sensor 8.

It is also possible for one pressure sensor to be assigned to each fuel injection valve 5.

If the phase relationship is incorrect by 360° KW upon starting, blowback by compression counterpressure is effected into an affected injection valve. This leads to a pressure increase in the fuel rail, and this increase is recorded by the sensor 8. This can be evaluated via a simple analog/digital comparator circuit (not shown) and is output to the control unit 25 as a signal. There, a reverse synchronization of ignition and injection by 360° KW is output. The evaluation of the measured rail pressure can also be done in some other way directly in the control unit.

In terms of the method, after detection of the reference marking 14 at the transducer disk 16, a special injection takes place without ignition at top dead center. If the phase relationship is wrong, blowback into the corresponding fuel injection valve 5 takes place, with an ensuing pressure increase in the fuel rail 7. Once the pressure increase is detected, the fuel injection valve 5 is immediately closed, to prevent an excessive blowback. This is followed by reverse synchronization of injection and ignition by 360° KW by means of the control unit 25.

If the phase relationship is correct (injection at charge change, top dead center), no pressure increase takes place in the fuel rail sensor. The injection and ignition can begin in the next cylinder with a correct phase relationship.

List of Reference Numerals

1 Fuel
2 Air
3 Throttle valve
4 Intake tube
5 Fuel injection valves
6 Motor/internal combustion engine
7 Fuel rail
8 Fuel rail sensor
9 Electric fuel pump
10 Fuel filter
11 Pressure regulator
12 Crankshaft
13 Angle markings
14 Reference marking
15 Pickup
16 Transducer disk
17 Sensors
18 Ignition switch
19 Memory
20 Processor unit
21 Output
22 Output
23 Battery
24 Switch
25 Control unit
26 Camshaft
KL.15 Terminal 15

What is claimed is:

1. An apparatus for controlling or regulating an internal combustion engine having a camshaft (26) and a crankshaft (12), whose annular position is ascertained continuously by means of a pickup (15) and a transducer disk (16) with a reference marking (14), having fuel injection valves (5) which inject the fuel (1) directly into the combustion chambers, and the fuel injection valves (5) are delivered the fuel (1) via a fuel rail (7) by an electric fuel pump (9) acted upon by pressure, having a control unit (25) and the fuel (1) is delivered to the fuel injection valves (5) via a fuel rail (7) by an electric fuel pump (9) acted upon by pressure, having a control unit (25) which evaluates the output signals of the pickup (15) to determine the annular position and to determine the rpm, and the control unit (25) trips injection and/or ignition pulses as a function of the annular position, characterized in that for detecting the phase relationship of the engine (6), a pressure sensor (8) is provided, whose pressure signal has a characteristic course upon blowback at compression counterpressure of fuel-air mixture into one of the fuel injection valves (5) in the event of an incorrect phase relationship, offset by 360° KW, between the ignition and the injection, which leads to a significant increase in the pressure sensor signal, and the pressure sensor signal is delivered to the control unit (25) and by way of it a reverse synchronization by 360° KW of the ignition and injection is effected.

2. The apparatus of claim 1, characterized in that one pressure sensor (8) is assigned to each fuel injection valve (5).

3. The apparatus of claim 1, characterized in that for all the cylinders, only one pressure sensor (8) is provided, which is disposed in the fuel rail (7).

4. The apparatus of claim 3, characterized in that the pressure sensor (8) is identical with the fuel rail sensor.

5. The apparatus of claim 1, characterized in that the signal of the pressure sensor (8) is evaluated via an analog/digital comparator circuit and delivered to the control unit (25).

6. A method for controlling or regulating an internal combustion engine of claim 1, characterized in that after detection of the reference marking (14) of the transducer disk (16) at the first top dead center, a special injection without ignition takes place at top dead center.

7. The method of claim 6, characterized in that subsequently in the event of an incorrect phase relationship, a blowback into the fuel injection valve (5) takes place by means of the compression counterpressure, and this blowback leads to a pressure increase in the pressure sensor (8), as a result of which, via the control unit (25), the affected fuel injection valve (5) is immediately closed, and a reverse synchronization by 360° KW of the ignition and injection is performed.

* * * * *